US005984800A

United States Patent [19]

Uebelhor

[11] Patent Number: 5,984,800

[45] Date of Patent: Nov. 16, 1999

[54] GOLF PUTTER HEAD AND PROCEDURE

[76] Inventor: Robert N. Uebelhor, 7611 S. Meridian St., Indianapolis, Ind. 46217

[21] Appl. No.: 09/063,459

[22] Filed: Apr. 21, 1998

[51] Int. Cl.[6] ..... A63B 53/04

[52] U.S. Cl. ..... 473/251; 473/252; 473/340

[58] Field of Search ..... 473/250, 251, 473/252, 253, 254, 255, 340, 341, 349, 335, 329, 219; 273/DIG. 16

[56] References Cited

U.S. PATENT DOCUMENTS

| | | | |
|---|---|---|---|
| 4,369,974 | 1/1983 | Komperda | 473/250 |
| 5,308,068 | 5/1994 | Strand | 473/251 |
| 5,320,353 | 6/1994 | Moore | 473/255 |
| 5,324,031 | 6/1994 | Green | 473/252 |
| 5,643,100 | 7/1997 | Zabytko et al. | 473/252 |

*Primary Examiner*—Sebastiano Passaniti
*Attorney, Agent, or Firm*—Robert A. Spray

[57] ABSTRACT

A novel head for a golf putter. A block body has a sole and at least one side wall extending upwardly, with a supplemental body inlaid onto the block body. One edge of the supplemental body is positioned contiguously adjacent the block body's side wall. The supplemental body is formed of laminated strips of stock of differing colors, and the strips are cut at two angles to the block body, a variation in coloration appearing by the exposed end portions of successive sheets of stock. The cutting of the strips of stock is done after the supplemental body is inlaid onto the block body, providing that the adjacent portions of the block body's side wall and the supplemental body are flush with respect to one another, with the block body's side wall serving as a template. The cutting at a compound angle achieves a design of lining and coloration which is other than fore-and-aft.

7 Claims, 3 Drawing Sheets

GOLF PUTTER HEAD AND PROCEDURE

I. FIELD OF THE INVENTION

The present invention relates to golf equipment, and more particularly to golf clubs of a special form for particular use in effecting a putting stroke, such clubs being commonly known as putters, and for the procedure of making them.

Although not limited to putting strokes, putters generally have the particular function of a relatively light stroke for imparting energy to cause the ball to receive enough only to travel a relatively short distance on the generally smooth surface of the putting green which contains the hole as a specific target.

Accordingly, in contrast to other golf clubs, putters are desirably formed for achieving a quite precise travel of a ball with respect to both distance and direction, by a stroke which is restricted and precisely aimed.

II. PROBLEMS INHERENT AS TO THE PROVISIONS OF A GOLF PUTTER

Several inherent particulars of the use of a putter club provide problems which must be solved to make any particular overall construction of a putter head desirable.

For example, it must be quite accurate in construction for achieving accuracy of effect, a high degree of accuracy to consistently and confidently achieve the intended purpose.

Thus, the overall weight must be such that the combination of the putter head and its carrying shaft gives a desirable "feel" to the user as the putter is used for shots of varying amounts of length, green slope, green texture, etc.

As is mentioned herein, the putter must desirably have enough reasonableness of looks and feel as to give the user maximum confidence, even though this factor is so subjective to the particular user as to make it a matter of some uncertainty as to any of the several particulars of club design.

Moreover, the matter of confidence in use seems to be such a fanciful and illusive factor that even skilled golfers disagree with others, and even disagree with their own selves, from time to time, as to the help which individual characteristics of the putter club actually are and contribute to the overall achievement.

As a practical matter, the putter head design has to be in realization of the fact that, for confidence or whatever other attribute the putter head itself seems to convey, the characteristics which are both visible and "feelable" to the user must be such as to impress the user as a potential purchaser and contribute to the user's subsequent use of the putter in the actualities of practice and of the challenge of the golf play itself.

III. SUMMARY OF THE INVENTION

In the preferred form of this invention, its concepts may logically be considered to partake of concepts to both the the device and procedure for making the device.

That is, as considering as to both aspects, the invention may be summarized to be a golf putter head comprised of a block body having a sole,and at least one side wall extending upwardly from the sole with a supplemental body inlaid onto the block body. One edge of the supplemental body is positioned contiguously adjacent the block body's side wall.

The supplemental body is formed of laminated strips of stock of differing colors and the strips of stock which are disposed along the block body adjacent at least one end thereof are cut at an angle to the block body, i.e., cut such that a variation in coloration appears by the exposed end portions of successive sheets of stock.

From a procedure standpoint, the cutting of the strips of stock is done after the supplemental body is inlaid onto the block body, by means which achieves that cutting to be such as to achieve the plane of cutting to be in conformity to the adjacent edge of the block body's side wall; and this provides that the adjacent portions of the block body's side wall and the supplemental body are flush with respect to one another, with the block body's side wall serving as a template guiding the cutting of the supplemental body.

The cutting is significantly other than parallel to the stock of strips of the supplemental body, thus achieving a design of lining and coloration which is other than fore-and-aft, by the cutting being at a compound angle.

Other features and details are set forth herein.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively help to show the non-obviousness of this combination invention. E.g., a. The prior art has had several decades of invention and development of golf putters, and the countless attempts and improvement have been made; and a showing of the energetic developing activity through the years is shown merely by the many putters advertised commercially, most claiming a specific one or more improvements, as represented by this illustrative listing: Anser; B; Ballnamic; Blue Goose; Brittany; Bulls Eye; Calloway; Chancellor; Cleveland Classis; Crenshaw; Danish; Dead Center; Emperor; Gentle Ben; George Low Wizard; Gwen; Inertial; Jackson Lee; Jay Bird; John Schlee; Katlyn; Link-Master; Lizzy Beth; Lynx Parallax; MacGregor; Musty; Natural; Noble; O Moody; Odessey; Pal; Palmer; Pharoah; Ping; Pole Cat; Positive; Poz; Ram; Ray Cook; Redwood City; Response; Revealer; Scottsdale; Slotline; Smoothie; Sonia; Spald Tour; Spalding; Sweet Roll; Sweetheart; T.P.M.; T.P. Mills; Tad Moore; Target Line; Taylor Made; Teardrop; Techline; Thor; Tiffany; Titleist; Tommy Armour; Troy; Tsar; Traditional; Wilson; Wild Mountain; World Putting; Zapp; Zebra; and Zing;

b. Such a huge number of variations of these putter devices help to show that the novelty here is to be considered as inventive, for they show that this may be considered as quite a "crowded art"; and especially is this consideration logical when it is noted that putters are such "simple" things from the standpoint of their simplicity of construction;

c. More particularly, putters may be considered simply as "L-shaped tools", having no moving parts, and having only a very specific use; and yet through the years the inventive minds have sought to create the ideal putter by developments relating to the most minute construction features of putters, that is, each of the many features of: material density; head formations; one or more materials (wood, brass, titanium, copper, aluminum, etc.); precision of balance; size and location of what is considered to be a "sweet spot"; alignment details; relative location of the neck or hosel; casting procedures; flanges and weights; blade or mallet shape; provision of instancy of rolling effect; balance of face; milled face supposedly providing "gear grip action"; weight distribution;

offsetness of neck or hosel; "feel" and "touch" details; distinctiveness of appearance by shape and surface ornamentation; nature and location of recesses; supposed stability of putter sole; hosel features; various rear details; lie and loft details; supposed smoothness of stroke incentive; squareness of blade as stroked; supposed on-line travel of the ball; pendulum swing effect; consistency of effect; "solidness of feel"; nature of aiming lines; minimization of "ricochet and hop"; inertia of weighting system; aspect of center of gravity to point of impact; "softness of feel as sensed"; curvature of face; "dual radius" nature of head face; rotatable sole; plastic-filling of the head; gooseneck nature of neck or hosel; "unit-cell" head construction; in-line aiming and directional control capabilities; peripheral details; counterbalancing of head; relation of tail section to toe section to yield an increased static moment for making face having tendency to stay square to the swing path; forwardly offset portion above the head to enable observation of golf ball and putter face at address and as the putter face approaches and strikes the ball; and face plate nature; etc.;

d. All of the various attempts and changes illustrate not only the attempts but the unique problems of putter head design; and all of the efforts to make the "ideal" putter are realistically encumbered by the fact that no one seems to know for sure what is the critical factor or factors involved;

e. The increasing growth of golf as a pastime has shown that there are an increasing number of persons and manufacturers who would be supposed to be quite willing to deal in putter improvements;

f. Putters, in contrast to other golf clubs, are not generally considered a part of an inter-related set of clubs, and thus more golfers would be supposed to be potential customers of putters than the lesser number who would be likely to be in the market to purchase an entire set of replacement clubs;

g. The relative simplicity of putters, as an item of construction, has surely given manufacturers ample incentive to have made modifications for commercial competitiveness in a competitive industry with huge sales prospects reasonably expectable;

h. The prior art has always had sufficient skill to make many types of putters, more than ample skill to have achieved the present invention, but only if the concepts and their combinations had been conceived;

i. Substantially all of the operational characteristics and advantages of details of the present invention, when considered separately from one another and when considered separately from the present invention's details and accomplishment of the details, are within the skill of persons of various arts, but only when considered away from the integrated and novel combination of concepts which by their cooperative combination achieves this advantageous invention;

j. The details of the present invention, when considered solely from the standpoint of construction, are relatively simple, and the matter of simplicity of construction has long been recognized as indicative of inventive creativity;

k. The prior art has shown that it is willing to use and undertake developments of various factors of putter head design including use of laminated sheets;

l. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate;

m. The prior art has long had mechanisms and production equipment of various kinds which could produce all of the particulars of the present invention;

n. With increasing intensity of golf as a universal pastime, and with the likelihood that many golfers would be willing to purchase a replacement putter in contrast to individual other clubs or club-sets, the likelihood of huge sales prospects is magnified;

o. The cost of manufacture of a putter, even including the extra cost of two-unit type, is sufficiently low as to be within the marketability or supposed-market-ability in this aggressive industry;

p. It is generally believed that many or most golfers are persons of pride or hopeful pride in their golfing skills, and the matter of an improved putter would be particularly an incentive to purchase, as most golf equipment manufacturers would surely believe and promote; and q. Accordingly, although the prior art has had capability and motivation, amply sufficient to presumably give incentive to the development of specialized golf putters according to the present invention, the fact remains that the present invention awaited the creativity and inventive discovery of the present inventor. In spite of ample motivation and capability shown by the illustrations herein, the prior art did not suggest this invention.

V. PRIOR ART FACTORS, AS PARTICULAR INSTANCES OF FAILURE TO ACHIEVE THE PRESENT CONCEPTS

In view of all of these factors of capability and motivation, it may be difficult to realize that the particular combination of the two-unit basic construction has not been conceived, even though the golf equipment industry development is quite commercial and competitive. Further, the persons of sufficient knowledge and skill to have achieved this combination surely include a multitude of manufacturers and users of golf club putters of various designs, such that this combination invention would have come about if its concepts had been obvious.

Some recent prior art which has come to the attention of this inventor after his invention is illustrated by the voluminous types of developments of golf putters through the decades, as already illustrated.

Search efforts have shown the prior art as illustrated in the following U.S. Patents and ones cited therein:

| | |
|---|---|
| Antonious | 4,826,172 1989 |
| Finney | 4,995,612 1991 |
| Antonious | 5,011,151 1991 |
| McNally, et al. | 5,026,056 1991 |
| Gorman | 5,048,834 1991 |
| Gorman | 5,048,835 1991 |

-continued

| | |
|---|---|
| Finney | 5,060,950 1991 |
| Gorman | 5,074,563 1991 |
| Solheim | 5,193,805 1993 |
| Kranenberg | 5,439,222 1995 |
| Schmidt (Callaway) | 5,460,377 1995 |
| Jimenez | 5,494,288 1996 |
| Rife | 5,562,551 1996 |
| Besnard, et al | 5,643,112 1997 |
| Gutherie | 5,700,207 1997 |

Without implying thoroughness, all of this prior art through the years illustrates the long-continuing inventorship and developements, but none shows or suggests the present invention.

VI. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present creativity. More particularly as to the novelty here of the invention as considered as a whole, the candid reference to the prior art uses and needs helps to show its contrast to the present concepts, and emphasizes the advantages, novelty, and the inventive significance of the present concepts as are here shown, particularly as to salability, characteristics of use in practice and actual play, and confidence of use.

Moreover, prior art articles known to this inventor which could possibly be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded, and ample motivation is shown and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a combination device achieving the combination of confident feel and accuracy in use, and other advantages of the present invention, which are goals only approached by the prior art, must be recognized as showing a long-felt need fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hingsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

The above description of the novel and advantageous invention is of somewhat introductory and generalized form. More particular details, concepts and features are set forth in the following and more detailed description of the preferred embodiments,taken in conjunction with the accompanying Drawings which are of somewhat schematic and diagrammatic nature for showing the inventive concepts.

In the Drawings:

FIG. 1 is a pictorial view of a golf putter head according to one embodiment thereof, showing the club head in a finished form by which the procedure of construction has imparted a design to the top portion of the club head, with the design portion being shown in the background;

FIG. 2, in somewhat enlarged form, is a pictorial view of the club head of the first embodiment, but with the design portion of the club head being shown in the foreground and the ball-striking face of the putter head shown in the background;

Figure 1:
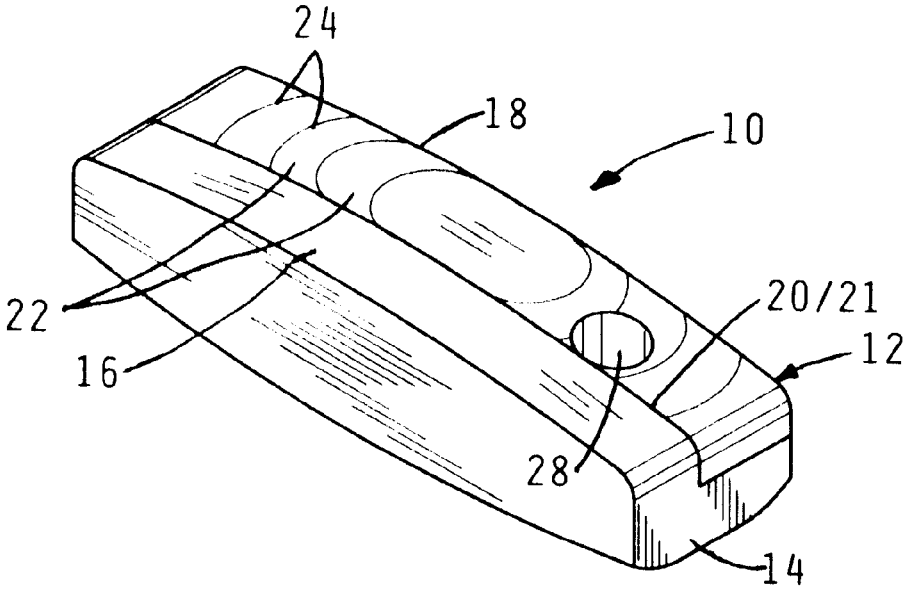
Figure 2:
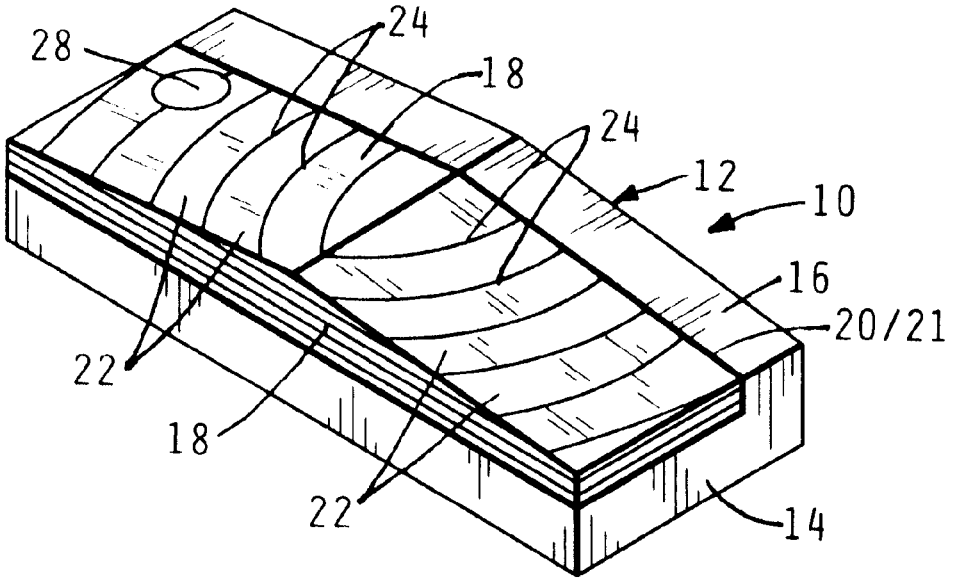
Figure 3:
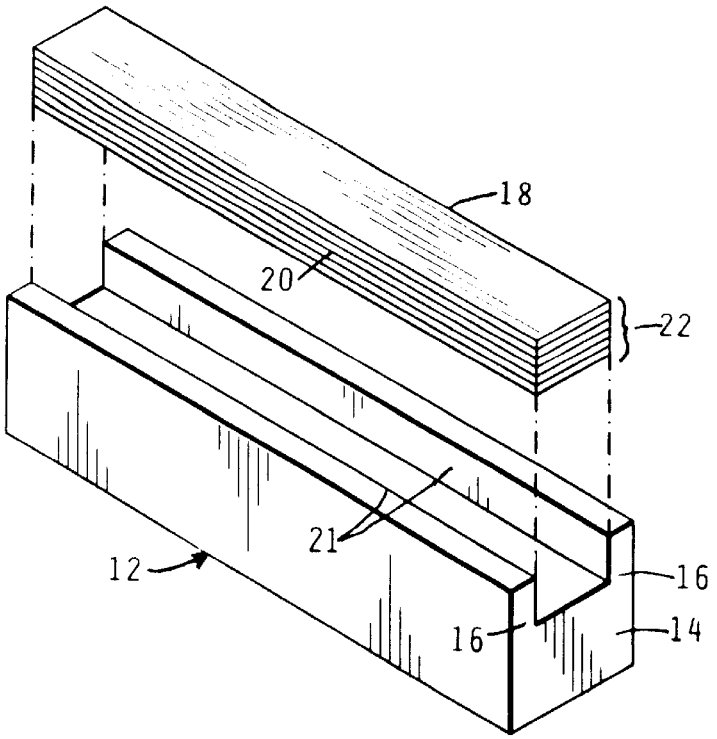
FIG. 3, is an isometric view of the putter head of a second embodiment, showing in exploded view the supplemental body to be inlaid along both the forward and the rearward edges of the principal body member of the club head.
Figure 4:
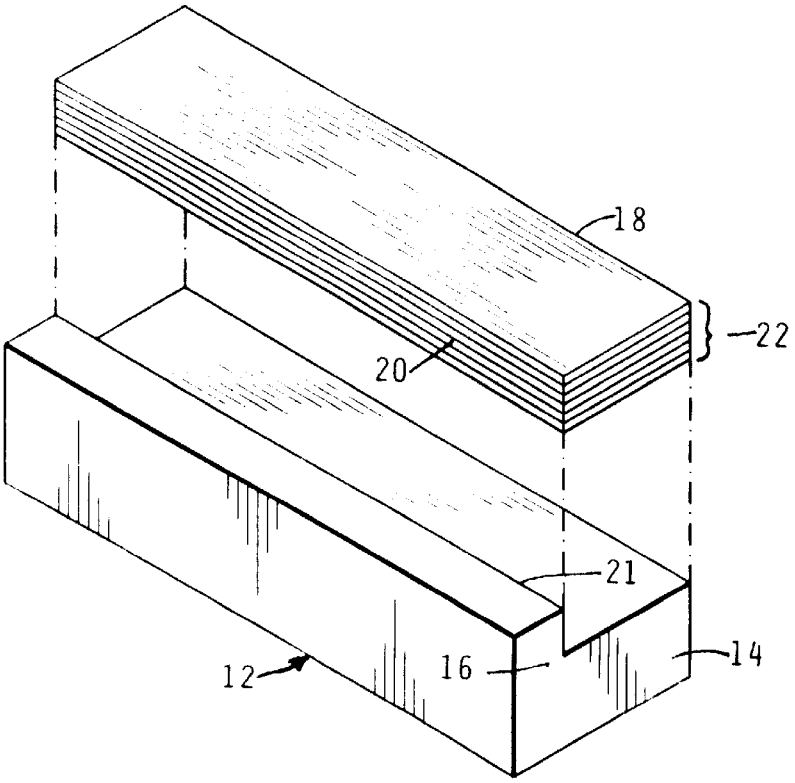
FIG. 4, is an isometric view of a construction step for the embodiment of the club head shown in FIGS. 1 and 2.
Figure 5:
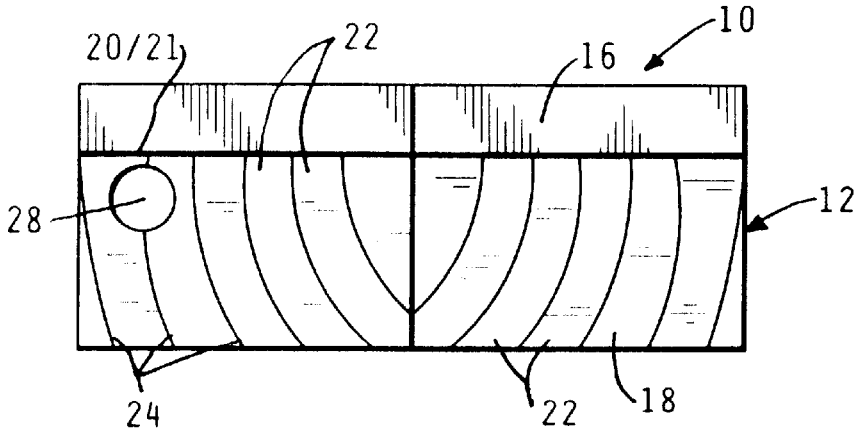
FIG. 5 is a plan view of the finished putter head of the construction shown in FIGS. 1 and 2.
Figure 6:
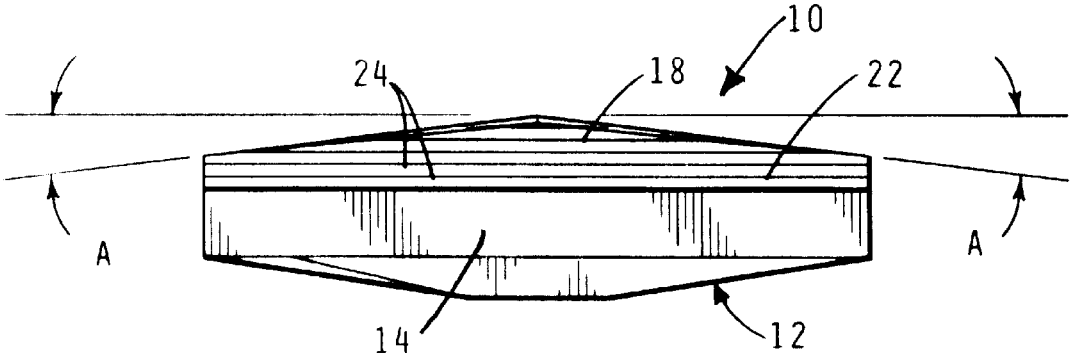
Figure 7:
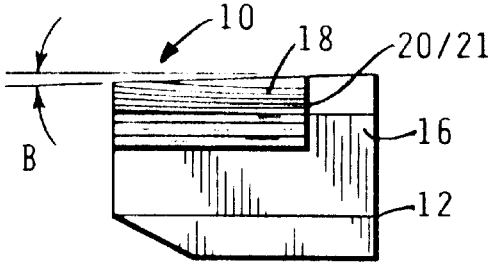

FIG. 6 is a side elevation view of the putter head of both of the embodiments of FIGS. 1–5, with the club head face which strikes the ball in the foreground of this view; and FIG. 7 is an end view of a putter head according to the embodiment shown in FIGS. 1,2 and 4–6, with projection lines showing that the cutting means is also at an angle fore-and-aft as well as at an angle lengthwise as shown in FIG. 6, thus achieving the interesting non-transverse striping effect of the finished putter head form as shown in FIGS. 1,2 and 5.

VIII. DETAILED DESCRIPTION OF EMBODIMENTS

The seven Figures of Drawings illustrate the two embodiments, their differences being as illustrated in a comparison of FIGS. 3 and 4.

In the Drawings FIGS. 1,2, 4 and 5 illustrate the putter head 10 having a block body 12 having a sole 14 and a side wall 16 extending lengthwise upwardly from the sole 14.

A supplemental body 18 is inlaid onto the block body 12, with an inner edge 20 of the supplemental body 18 lying contiguously adjacent an edge 21 of the block body's side wall 16; and for providing the interesting coloration of the club head 10, the supplemental body 18 is specially formed of a stack of laminated strips 22 of stock of differing colors.

Procedural steps or aspects are to be noted as follows: One procedural step is that the strips 22 of stock which are disposed along the block body 12 adjacent at least one end of the block body 12 (shown here as both ends), are cut at an angle "A" (see FIG. 6) to the block body 12 such that a variation in coloration appears (see FIGS. 1,2 and 5) by the end portions 24 of each of the stacked sheets 22 of stock lying successively spaced adjacent one another.

The second procedural aspect to be noted (see FIG. 7) is that the cutting is also at a relatively shallow angle "B" considered transversely of the club head 10.

The third procedural aspect is that of the cutting of the strips 22 of stock of body 18 advantageously after the supplemental body 18 is inlaid onto the block body 12, by means which achieves that cutting to be such as to achieve the plane of cutting to be in conformity to the adjacent edge 21 of the block body's side wall 16, providing that the adjacent portions of the block body's side wall 16 and the supplemental body 18 are flush with respect to one another, with the block body's side wall 16 permitted to serve as a template guiding the angle-nature cutting of the supplemental body 18.

It is to be noted that the means of cutting (noting angles "A" and "B") is significantly other than parallel to the stack of strips 22 which comprise the supplemental body 18, thus achieving a design of lining and coloration (noting FIGS. 1,2 and 5) which is other than fore-and-aft to the overall block body 12.

The cutting as per angles "A" and "B" might be termed as cutting at a compound angle, being at an angle both fore-and-aft and transverse with respect to both the length of and also transverse to the length of the putter head 10, thus providing that the coloration of the supplemental body 18 is other than fore-and-aft to the overall block body 12, again noting FIGS. 1,2 and 5.

As a second embodiment (FIG. 3) the side wall 16 extends upwardly from both side edges 21 of the block body 12, and the supplemental body 18 lies contiguously adjacent both of the block body's side walls 16/21, the supplemental body 18 being inlaid between the block body's side walls 16/21.

Both embodiments show a hole 28 for reception of the neck or hosel of the club shaft.

Summarizing the details of construction and concepts, and of aspects and of steps of procedure, it is seen that they cooperate to provide a top surface of a putter head 10 of contrasting natures, high appeal, a putter useful in play, a putter of pride to the owner.

IX. CONCLUSIONS AS TO INVENTIVE COMBINATION

It is thus seen that a golf putter head, formed according to the combination of inventive concepts and details herein set forth, provides novel concepts of a desirable and usefully advantageous article, yielding advantages which are and which provide special and particular advantages when used as or for a golf putter head.

In summary as to the nature of the overall club head's advantageous concepts, their novelty and inventive combination is shown by novel features of concept and procedure shown here in advantageous combination and by the novel combinations hereof not only being different from all prior art known, even though many other putter heads of various assemblies have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of golf club putter heads for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of golf club putter heads.

The differences of concept, of construction and procedure, yield advantages over the prior art; and the lack of this invention by the prior art, as an inventive combination, has been in spite of this invention's apparent simplicity of the construction once the concepts have been conceived, in spite of the advantages it would have given, and in spite of the availability of all of the materials to all persons of the entire world, and the invention's relatively non-technical and openly-visible nature.

Quite certainly this particular combination of prior art details as here presented in this overall combination has not been suggested by the prior art, this achievement in its particular details and utility being a substantial and advantageous departure from prior art, even though the prior art has had somewhat similar components separately for numbers of years.

Particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of golf putter head articles not achieving particular advantages here achieved by this combination.

Accordingly, it will thus be seen from the foregoing description of the invention according to the illustrative embodiments,considered with the accompanying Drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiments,or form or arrangement of parts herein described or shown.

What is claimed is:

1. A golf putter head, comprising, in combination, a block body having a first top surface a sole and at least one side wall extending upwardly from the sole;

and a supplemental body inlaid onto the block body, with one edge of the supplemental body lying contiguously adjacent the block body's side wall;

the supplemental body being formed of laminated strips of stock of differing colors;

the strips of stock which are disposed along the block body adjacent at least one end of the block body being cut at an angle to the block body such that a variation in coloration appears by the end portions of each of the sheets of stock lying successively spaced adjacent one another.

2. A golf putter head as set forth in claim 1, in which the cutting of the strips of stock is done after the supplemental body is inlaid onto the block body, wherein the plane of cutting is in conformity to the adjacent edge of the block body's side wall, thus providing that the adjacent portions of the block body's side wall and the supplemental body are flush with respect to one another, with the block body's side wall serving as a template guiding the cutting of the supplemental body.

3. A golf putter head according to claim 2, in which the cutting is significantly other than parallel to the stack of strips of the supplemental body, thus achieving a design of lining and coloration which is other than fore-and-aft to the overall block body.

4. A golf putter head according to claim 2, in which the cutting is at a compound angle, being at an angle both fore-and-aft and transverse with respect to the length of the putter head, thus providing the coloration of the supplemental body to be other than fore-and-aft to the overall block body.

5. A golf putter head as set forth in claim 1 having at least two side walls, in which each of said side walls extends upwardly from side edges of the block body, and the supplemental body lies contiguously adjacent both of the block body's side walls, the supplemental body being inlaid between the block body's side walls.

6. A golf putter head as set forth in claim 1, in which the supplemental body has an uppermost strip of stock forming a second top surface, said two top surfaces of the respective parts co-operating to provide an overall top surface of the putter head of contrasting natures.

7. A golf putter head as set forth in claim 2, in which the supplemental body's uppermost strip of stock forming a second top surface, the said two top surfaces of the respective parts co-operating to provide an overall top surface of the putter head of contrasting natures.

* * * * *